US009738998B2

(12) United States Patent
Scott

(10) Patent No.: US 9,738,998 B2
(45) Date of Patent: Aug. 22, 2017

(54) FORMING SHAPES WITH AN EMBROIDERY MACHINE

(71) Applicant: Felecia Shawn Scott, Clovis, CA (US)

(72) Inventor: Felecia Shawn Scott, Clovis, CA (US)

( * ) Notice: Subject to any disclaimer, the term of this patent is extended or adjusted under 35 U.S.C. 154(b) by 40 days.

(21) Appl. No.: 14/993,089

(22) Filed: Jan. 11, 2016

(65) Prior Publication Data

US 2016/0201240 A1 Jul. 14, 2016

Related U.S. Application Data

(60) Provisional application No. 62/125,060, filed on Jan. 12, 2015, provisional application No. 62/116,371, filed on Feb. 14, 2015.

(51) Int. Cl.

| | |
|---|---|
| ***D05B 19/12*** | (2006.01) |
| ***D05B 19/16*** | (2006.01) |
| ***D05C 7/02*** | (2006.01) |
| ***D05C 17/00*** | (2006.01) |

(52) U.S. Cl.

CPC ..... *D05B 19/12* (2013.01); *D05B 19/16* (2013.01); *D05C 7/02* (2013.01); *D05C 17/00* (2013.01); *D05D 2305/00* (2013.01)

(58) Field of Classification Search

CPC ..... D05B 19/00; D05B 19/003; D05B 19/12; D05B 19/16; D05B 3/04; D05B 3/12; D05B 11/00; D05B 31/00; D05B 39/00; D05B 85/00; D05B 81/00; D05C 7/02; D05C 7/00; D05C 7/04; D05C 7/10; D05C 1/02; D05C 1/04; D05C 9/04; D05C 9/06; D05C 9/10; D05C 9/12; D05C 17/00; D05C 17/023; D05D 2305/00

See application file for complete search history.

(56) References Cited

U.S. PATENT DOCUMENTS

| | | | | |
|---|---|---|---|---|
| 4,517,910 A * | 5/1985 | Jalowsky | D05C 17/00 | 112/439 |
| 5,531,176 A * | 7/1996 | Johnson | D06Q 1/00 | 112/439 |
| 6,164,228 A * | 12/2000 | Lin | D05C 17/00 | 112/439 |
| 6,263,817 B1 * | 7/2001 | Tajima | D06Q 1/005 | 112/439 |
| 6,443,081 B1 * | 9/2002 | Quint | D05B 97/12 | 112/439 |
| 6,718,895 B1 * | 4/2004 | Fortuna | D05B 19/08 | 112/475.19 |
| 6,860,214 B1 * | 3/2005 | Wang | D05C 15/00 | 112/475.22 |
| 6,994,044 B2 * | 2/2006 | Kwon | D05C 17/00 | 112/439 |
| 8,522,702 B1 * | 9/2013 | Cho | D05C 17/00 | 112/100 |
| 2011/0041741 A1 * | 2/2011 | Cohen | D05C 17/00 | 112/439 |

* cited by examiner

*Primary Examiner* — Ismael Izaguirre
(74) *Attorney, Agent, or Firm* — John Chandler

(57) ABSTRACT

Described is a method for using an embroidery machine or sewing machine to form shapes in, and extract shapes from, a sheet of material. A needle-based machine uses its needle to generate a series of perforations to cut out or assist in the separation of the shapes. Stitching facilitates operation of the machine. Preferably, perforations are made with a computer-controlled machine using instructions generated from or available in an electronic file.

20 Claims, 3 Drawing Sheets

FORMING SHAPES WITH AN EMBROIDERY MACHINE

CROSS-REFERENCE TO RELATED APPLICATIONS

This application claims priority to, and the benefit of, U.S. provisional patent application filed on 12 Jan. 2015 and having Ser. No. 62/125,060 and U.S. provisional patent application filed on 14 Feb. 2015 and having Ser. No. 62/116,371.

BACKGROUND

Field

This disclosure relates to embroidery machines, sewing machines and die cutting machines.

Description of Related Art

Die cutting is the process of placing a template over a material like paper or leather and pressing the template through the material until the shape is separated from the sheet of material. According to modern techniques, a laser, rolling blade or other cutting implement is controlled by a computer. A computer-controlled cutting head passes over a sheet of material making cuts to separate the shape from the material. In this way, shaped products are formed. Products of a predictable and desired size and shape are thereby produced.

Use of a mallet to beat a metal template into a sheet of material was replaced by belt-driven die-cutting machines during the late 1800's and those were replaced by swing arm clicker presses in the early 1900's. Like the name suggests, clicker presses had a moveable arm. Users swung aside the arm to rearrange materials and dies before proceeding to use the machine again. Today, the die cutting process is still used to manufacture everything from car parts and keys to jeans and shoes. Today, older types of machines have been replaced with smaller, computer-controlled die cutting machines. Even modern die cutting machines have certain disadvantages. For example, some modern die cutting machines still use a blade to cut the material. For home sewing machine and embroidery machine users, there is the added expense of a separate machine just to do cutting.

In contrast to a blade, embroidery machines use one or more needles to stitch thread or other material into a fabric or other material of choice. Some uses of embroidery machines include delivering stitching to the outer edge of die cut shapes. Thus, two machines are often necessary to produce certain finished products.

SUMMARY

Described herein is a method and device for creating or forming shapes from a sheet of material using a sewing action. A sewing machine or embroidery machine may be used.

One objective is to form shapes by mating a cardstock stabilizer to a first sheet of a first material of choice, reversibly engaging an embroidery hoop over at least the cardstock stabilizer, and then sewing, with at least one needle of the machine, a design for a shape into the first material of choice and cardstock stabilizer using a close-knit stitch pattern. The finished shape is then separated from the shaped cardstock stabilizer.

Another objective is to use a programmable and computer-operated machine for making the stitching. The design includes computer instructions for controlling the needle of the machine.

Another objective is to use, as a close-knit stitch pattern, an applique stitch pattern, a satin stitch pattern, or a zigzag stitch pattern. A variety of stitches can be used as long as the distance between successive stitching holes or needle insertions along the contour of the shape is small. For a zigzag or applique stitch, this distance may be small relative to the stitch length.

Yet another objective is to be able to mate two or more sheets of material together before adding a cardstock stabilizer, and then embroidering or making stitches in the combined sheets to for the shaped design. For example, a first and second sheet of a first material of choice can be added to the cardstock stabilizer. Two finished and separatable shapes from the material of choice may be made. The top most layer or sheet is the one embroidered. Sheets of different materials may be put together before being mated with the a cardstock stabilizer.

Another objective is to reversibly engage a material stabilizer such as an embroidery hoop over at least the cardstock stabilizer which is under the first sheet of the first material of choice. The material stabilizer can be an adhesive applied to either the cardstock stabilizer or material of choice. An embroidery hoop may be engaged onto one or more layers of material of choice to be sewn.

Another objective is to use an adhesive between the layers to be sewn. For example, a tape-based or spray-based adhesive can give improved results depending on the material to be sewn. Preferably, the adhesive leaves no residue on the finished products.

Another objective is to generate a stitched pattern comprised of just the sewn or embroidered portion of the material of choice. The material of choice is separated from both the inside and outside of the stitching.

This summary is provided to introduce a selection of concepts in a simplified form that are further described below in the detailed description. This summary is not intended to identify key or essential features of the claimed subject matter, and thus is not intended to be used to limit the scope of the claimed subject matter.

BRIEF DESCRIPTION OF THE DRAWINGS

While the appended claims set forth the features of the disclosure with particularity, the disclosure, together with its objects and advantages, is more readily appreciated from the following detailed description, taken in conjunction with the accompanying drawings. Throughout, like numerals generally refer to like parts. Unless specifically indicated, the components and drawings are not shown to scale.

DETAILED DESCRIPTION

Overview. The present disclosure provides details for using a needle-based machine to cut out or separate forms or shapes from a sheet of material. Preferably, the method involves use of a computer-controlled sewing or embroidery machine.

As described herein, a system and methodology have been developed which provides significant benefits and advantages over previous techniques and equipment. Recent advances in electronics and computer control have reduced the cost of a system that can be easily used to generate shapes from a material of choice or material of interest using a needle bearing machine such as a sewing or embroidery machine.

Some materials that may be worked include chipboard, thin laminate, plastic, acetate, transparency film, wood, sheet magnet, sheet metal, foil, felt, acrylic, clay, rubber, window cling, film, iron on sheet, adhesive tape, polystyrene plastic sheet, stencil sheet, foam sheet, paper (including cardstock, hand-made papers, tissue paper, sticker, vellum, mulberry, et al.) and various types of vinyl, board, leather, and cloth. Some of these materials cannot easily be embroidered with hand needles, primarily because these materials cannot be pierced. However, a computer controlled sewing or embroidery machine can be used. The following disclosure provides further details.

Figure 1:
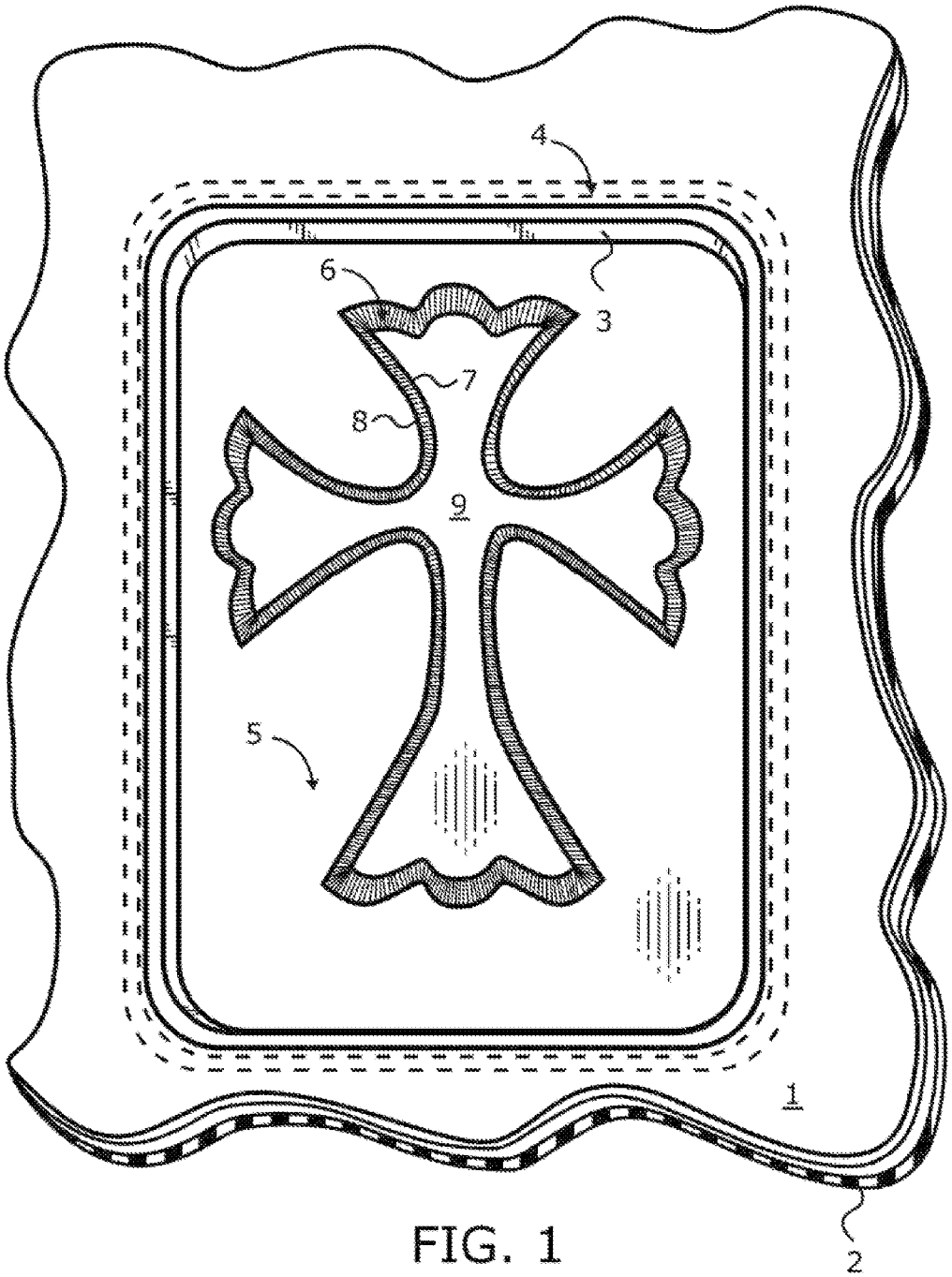
FIG. 1 shows a perspective overhead view of a material of interest and support material secured in a sewing or embroidery hoop with a design sewn into the combined material.

FIG. 1 shows a perspective overhead view of a material of interest and support material secured in a sewing or embroidery hoop with a design sewn into the combined material. The stitching has been made by a computer controlled sewing or embroidery machine. With reference to FIG. 1, a material of interest 1 has been placed over the top of a support material 2. According to a preferred implementation, the support material is a cardstock material known as a cardstock stabilizer. The cardstock material can be any of a variety of cardstock or cardstock-like material such as a 65 weight cardstock or chipboard such as the material commonly used for commercial food packaging. The method described herein does not require a traditional embroidery stabilizer at least partially because a traditional embroidery stabilizer such as a cutaway stabilizer does not lend itself to creating the tear away effect needed to make shapes with an embroidery machine without the need to use scissors.

The material of choice or material of interest 1 or "material" and support material 2 are held tightly and evenly by an inner embroidery hoop 3 pressed inside an outer embroidery hoop 4. The top surface 5 of the material 1 is inside the inner hoop 3. The material 1 and support material 2 pass over the outer hoop 4 (not directly visible) and under the inner hoop 3. A design 6 has been embroidered into the material 1 and support material 2. One or more needles (not shown) have passed through the material 1 along an inner line 7 and through the material 1 along an outer line 8. This technique has been done along the length of the design 6 or "shape frame." An inner portion or shape 9 is visible inside the design 6. Effectively, a series of perforations in the material of interest 1 and support material 2 are generated by the needle bearing machine.

While the material of interest 1 and support material 2 are shown in a material stabilizer or hoop 3, 4, the method may be practiced without them with certain materials that do not require tension in the material of interest 1. Preferably, the material of interest 1 and support material 2 are reversibly engaging a material stabilizer. While the hoop 3, 4 is shown as holding tension or securing the materials 1, 2 on all sides, such is not required. For example, the materials 1, 2 may be secured by rails (not shown) that hold tension in the materials 1, 2. Thus, the materials 1, 2 are held laterally are the materials 1, 2 are able to be stitched in a computer-controlled machine. As another example, instead of use of the embroidery hoop 3, 4 a spray adhesive may be applied between the material 1 and support material 2. In yet another non-illustrated example, a first rail and a second rail engage with the materials 1, 2. The rails include small hooks or points that engage into the materials 1, 2; the rails are pulled in different directions from one another thereby causing tension in at least the material of interest 1. The rails do not necessarily lie in parallel with one another, and may be engaged and re-engaged with the materials 1, 2 during subsequent times during sewing, embroidering or operation of the machine. Thus, a material stabilizer may take different forms and performs a function of assisting with proper stitching or perforation of the materials 1, 2.

Figure 2:
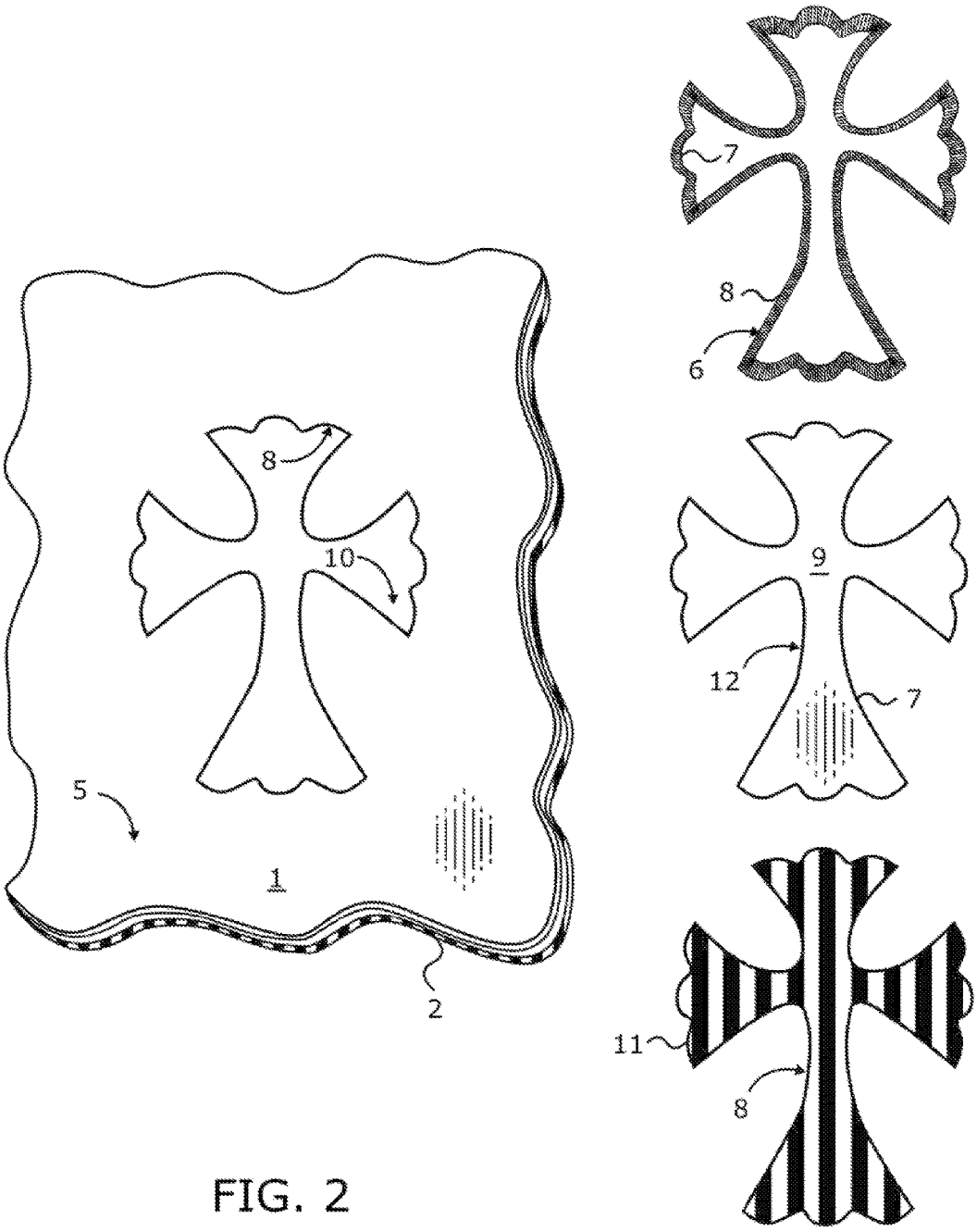
FIG. 2 shows an overhead view of the materials and design first shown in FIG. 1.

FIG. 2 shows an overhead view of the materials and design first shown in FIG. 1. With reference to FIG. 2, a material of interest 1 and support material 2 has been separated from the embroidery hoop (not shown). The top surface 5 of the material 1 is visible. A void 10 or negative space of the same shape and size of the outer periphery of the design 6 is visible in the combined materials 1, 2. The void 10 or negative space can be used as a stencil.

A separate shape 9 the size of the inner line 7 also has been produced. The shape 9 has been separated from its support material shape 11. A shape 9 equivalent to a shape cut by a die cutting machine has been produced. A combination of material 1 and support material 2 yields an unexpectedly smooth outer edge 12 along the shape 9 and along the support shape 11. According to one implementation, a user has taken an extra step and separated the stitched or embroidered design 6 from the shape 9. The design 6 includes stitching and a thin band of the material of interest 1.

Optionally, depending on the support material 2, the finished design 6 may include a thin band of the support material 2. Production of such a design 6 and shape 9 are not possible with an ordinary die cutting machine. Clear glue can be applied to the back of the embroidered shape 6 prior to separating the inner shape 9 from the embroidered shape 6 so as to discourage separation of the design 6 from the inner shape 9 so that a combination of the embroidered shape 6 and inner shape 9 is the result. Depending on the material of interest 1 such as the thickness of the material, scissors may be needed to start the tear away or separation process that isolates the inner shape 9 and/or design 6. An embroidery shape frame 6 can be produced in a variety of colors (of the materials 1, 2) and thread types thereby producing a large variety of combinations. Embroidery frames 6 can be used as separate embellishments or can be mixed and matched with corresponding non-embroidered shapes which can be generated in different types, colors, patterns and types of material.

Figure 3:
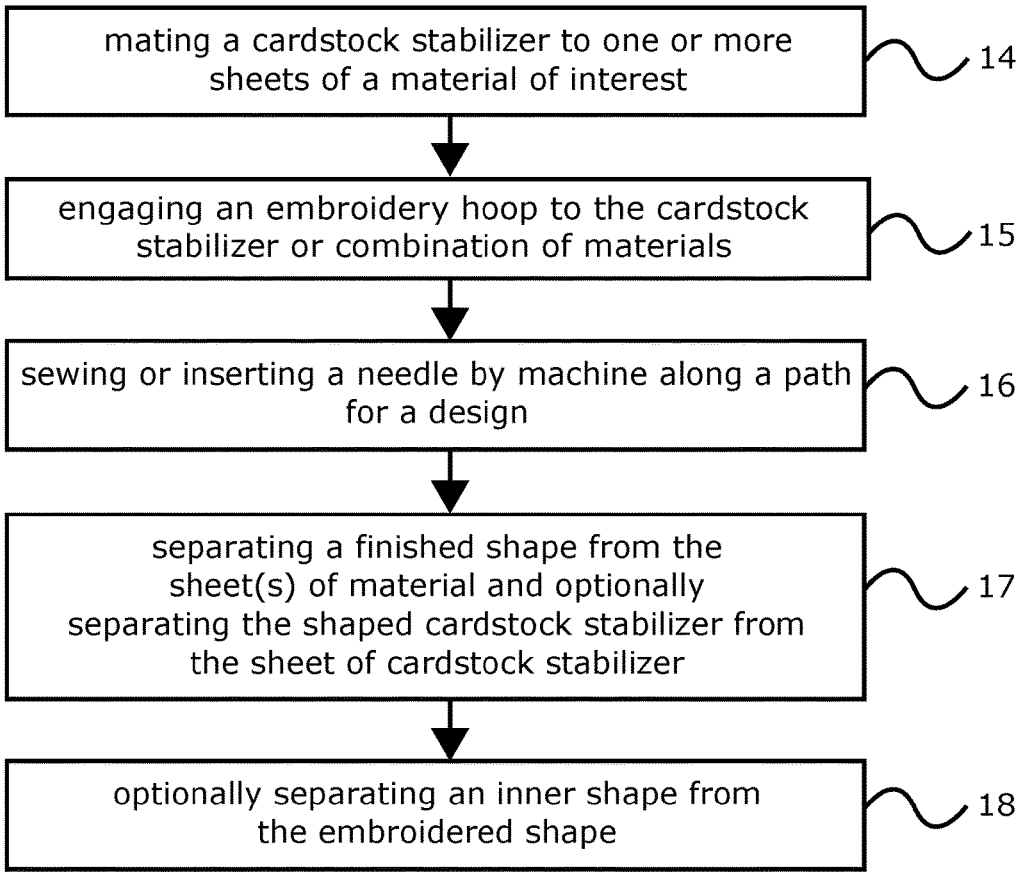
FIG. 3 illustrates a method for forming shapes with a sewing or embroidery machine.

FIG. 3 illustrates a method for forming shapes with a sewing or embroidery machine. With reference to FIG. 3, a method of forming shapes from a sheet of material using an embroidery or sewing machine includes a step 14 of mating a cardstock stabilizer to a sheet of a material of choice or material of interest 1. More than one sheet of material can be used. That is, two or more layers or sheets of materials can be used. The layers can be of a same or different material so that multiple copies of a shape 9 and stitched design 6 can be generated with a single pass of a stitching or embroidery machine. Only one design 6 (the embroidered die cut) can be made at a time. However, multiple designs of the shape 9 can be made at a time along with one stitched design 6 simultaneously with each use of the needle-bearing machine.

Another step 15 includes reversibly engaging an embroidery hoop over at least the cardstock stabilizer. If just the cardstock stabilizer is secured to the hoop, then a material of interest should be secured to the cardstock stabilizer with tape or adhesive. Preferably the embroidery hoop is placed over the cardstock stabilizer and material of interest.

Next, a subsequent step 16 includes sewing a design for a shape with a needle of a machine. The sewing is done into the first material of choice and cardstock stabilizer with a close-knit stitch pattern. That is, needle insertions are made substantially proximate to each other when viewed along either an outer outline of a shape or an inner outline of the shape. Such proximate needle insertions are along the inner line 7 and outer line 8 as illustrated in FIG. 1. A width of the zigzag or cross-stitching of the design 6 is substantially immaterial to creating and separating a shape from a material of interest. Thus, a zigzag, satin or other close-knit stitching pattern may be used. Such stitching pattern may be selected from those available on a particular sewing or embroidery machine.

In a next step 17, the finished shape of the material of interest is removed from the sheet of material and from the underlying and shaped cardstock stabilizer. This step 17 is typically done manually. This step 17 may involve separating the shape by breaking the bridges of material between perforations. Ideally, the material between needle perforations has been weakened so that separation is simply a matter of passing a finger or tool along the shape.

According to an optional step 18, a frame shape or embroidered shape 6 may be separated from an inner shape 9. Alternatively, the inner shape 9 and embroidered shape 6 may be left connected together, and a finished shape is created by separating the sheet of material 1 from the finished shape at the outer line 8 (shown in FIG. 2).

Using these techniques to create shapes is superior to using a die cutting machine because traditional die cutting machines cannot make die cut embroidered shapes. Further, a support mat is typically required for die cutting machines. The material of interest and the finished shape must be pulled away from the support mat. Such a step, if performed incorrectly, can introduce damage to a resultant shape generated by a die cutting machine. Using the techniques described herein, multiple shapes can be made at one time depending on which medium or material of interest is used. This method also works with certain commercially available sewing machines and many sewing/embroidery machines. Many currently available and computer-controlled machines come with pre-installed shapes. The techniques described herein can be used to form and extract these pre-installed shapes from a material of interest.

The techniques described herein can be used with many digital files, design files and digital file formats. That is, the techniques can be used with electronic files that include designs or instructions for computer-controlled needle bearing machines such as sewing machines and embroidery machines. For example, the techniques can be used with file types with an extension such as .svg, .png, and vector-based electronic files. Such files can be converted into an applique digital design or a stitch-enabled file that functions to instruct a sewing machine or embroidery machine to make stitches or needle insertions as described herein.

Most designs that can be cut on a computer-controlled die cutting machine can be generated with an embroidery machine. Via electronic means, a hand drawn image may be scanned and converted into a digital applique file or other type of electronic file programmed with instructions to use a satin stitch or other zigzag or back-and-forth stitch. Such an electronic file can be used with an sewing machine or embroidery machine to yield the products as described. Thus, a stitching machine can be used to produce substantially equivalent products as those produced by a traditional die cut machine that uses a blade or laser to cut shapes.

Needles. The techniques described herein can be used with a standard-sized and standard-shaped needles. For example, a standard needle of size 75/11 can be used. Other needle sizes and shapes can be used. Many of the modern and computer-controlled embroidery machines and sewing machines assume use of a needle of a certain diameter, length and so forth. A needle having a non-circular profile may be used to increase the advantages described herein. Based on the geometries involved with making perforations in the material of interest, a needle having an ovoid or other cross-section may be used. For example, a need of a substantially square or rectangular cross-section may be used to cause improved perforations and for easier separation of the finished shapes. Specifically, using a needle of rectangular cross-section, with a long dimension or orientation along the axis or line of stitching may leave less material to break between successive needle perforations. The type, size and shape of needle may be varied and selected based on the material being worked. According to another implementation, a needle having one or more sharp edges along the body of the needle facilitates cutting and perforating of the material of interest. Further, according to yet another implementation, a need having one or more serrated edges provides improved performance and better results. Thus, an improved result is obtained over use of standard or round cross-section needles when using the techniques described herein.

Variations. According to one variation, shapes may be generated in a needle bearing machine without using thread and thus, one or more needles operate without inserting stitching into the material of interest. Of course a stitched shape 6 would not be generated, but such a result may be desired. According to another variation, the needle bearing machine operates on the material of interest, and any supporting material, two or more times—substantially in the same insertion points or needle holes—so as to yield perforations of sufficient number, size and/or character to enable the shape to be extracted easily from the sheet of material of interest and so that the edge of the shape and edge left along the void in the material of interest are of a desired smoothness or character.

Conclusion. Although the system and method have been described with reference to specific exemplary embodiments, it will be evident that modifications and changes can be made to these embodiments without departing from the broader spirit of the disclosure. Accordingly, the specification and drawings are to be regarded in an illustrative sense rather than in a restrictive sense.

Similarly, while certain exemplary embodiments have been described and shown in the accompanying drawings, it is to be understood that such embodiments are merely illustrative and not restrictive of the broad disclosure and that the provided disclosure is not limited to the specific constructions and arrangements shown and described herein, since various other modifications may be made according to the abilities of those ordinarily skilled in the art upon studying this disclosure. The disclosed embodiments may be readily modifiable as facilitated by enabling technological advancements without departing from the principals of the present disclosure.

I claim:

1. A method of forming shapes from one or more sheets of material using a needle bearing machine, the method comprising:

mating a cardstock stabilizer to a first sheet of a first material of choice;

reversibly engaging a material stabilizer onto at least the cardstock stabilizer so as to maintain a tension in the first sheet of the first material of choice;

sewing, with a needle of the machine, a design for a shape into the sheet of the first material of choice and cardstock stabilizer with a close-knit stitch pattern; and separating the finished shape of the first material of choice from the shaped cardstock stabilizer.

2. The method of claim 1, and wherein the method is performed with an embroidery machine, and wherein the embroidery machine is programmable and computer-operated, and wherein the design includes computer instructions for controlling the needle of the embroidery machine.

3. The method of claim 1, and wherein the close-knit stitch pattern is an applique stitch pattern, and wherein the finished shape includes an applique stitch pattern along the design in the first material of choice, and wherein the needle bearing machine forms stitches in at least the first sheet of the first material of choice.

4. The method of claim 1, and wherein the close-knit stitch pattern is a satin stitch pattern, and wherein the finished shape includes a satin stitch pattern along the design in the first material of choice.

5. The method of claim 1, and wherein the close-knit stitch pattern is a zigzag stitch pattern, and wherein the finished shape includes a zigzag stitch pattern along the design in the first material of choice.

6. The method of claim 1, and wherein the method further comprises mating a second sheet of the first material of choice between the cardstock stabilizer and the first sheet of the first material of choice.

7. The method of claim 1, and wherein the method further comprises mating a first sheet of a second material of choice between the cardstock stabilizer and the first sheet of the first material of choice.

8. The method of claim 7, and wherein reversibly engaging the embroidery hoop includes engaging the cardstock stabilizer, the first sheet of the first material of choice and the first sheet of the second material so as to maintain tension in the cardstock stabilizer, the first sheet of the first material of choice and the first sheet of the second material of choice.

9. The method of claim 7, and wherein the method further comprises including an adhesive between the cardstock stabilizer and the first sheet of the first material of choice or between the first sheet of the first material of choice and the first sheet of the second material of choice.

10. The method of claim 9, and wherein the adhesive is a sheet of sticky material that is removable without residue from a surface of the cardstock stabilizer, the first sheet of the first material of choice and the first sheet of the second material of choice.

11. The method of claim 1, and wherein the material stabilizer is an embroidery hoop.

12. The method of claim 1, and wherein reversibly engaging the material stabilizer includes engaging at least a portion of the first sheet of the first material of choice.

13. The method of claim 1, and wherein the method further comprises:

separating the inner non-stitched shape from the stitching of the finished shape of the first material of choice.

14. The method of claim 1, and wherein a size of the needle is 75/11 or smaller in diameter.

15. The method of claim 1, and wherein the needle includes a flat side parallel with the axis of the needle.

16. The method of claim 1, and wherein the needle is a needle with an ovoid cross-section.

17. The method of claim 1, and wherein the needle has a non-circular cross-section, and wherein the needle has a sharpened edge.

18. The method of claim 1, and wherein the needle has serrated edge.

19. A device of forming shapes from a sheet of material, the device comprising:

a needle mounted to a cam;

a first electric motor in mechanical communication with the cam;

a base surface for supporting a cardstock stabilizer and a first sheet material, and wherein the base surface is shaped to include an aperture for allowing the needle to pass through the cardstock stabilizer and the first sheet material;

a material stabilizer mechanically and reversibly engaged with the cardstock stabilizer and the first sheet material;

a second electric motor mechanically in communication with the material stabilizer;

an electronic memory programmed with instructions to (1) control operation of the cam and needle assembly via the first electric motor, and (2) move the material stabilizer via the second electric motor over the base surface according to a design for a series of perforations for the cardstock stabilizer and the first sheet material, and wherein the instructions are pre-programmed in the memory, and wherein the perforations correspond to the design, and wherein the first electric motor and the second electric motor are in electronic communication with and under control of the instructions of the electronic memory.

20. The device of claim 19, and wherein the needle includes an eye toward its distal end, and wherein the distal end of the needle is the end which engages with the cardstock stabilizer and the first sheet material, and wherein the device includes a thread that passes through the eye of the needle and causes stitching in the first sheet material.

* * * * *